US007467815B2

(12) United States Patent
Larsen et al.

(10) Patent No.: US 7,467,815 B2
(45) Date of Patent: Dec. 23, 2008

(54) SNOW LOAD LEVER WITH TWO PART PAWL LEVER CONSTRUCTION

(75) Inventors: Christopher L. Larsen, Toronto (CA); Jeffrey R. F. Domenchini, Etobicoke (CA); Keith A. Morgan, Toronto (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 522 days.

(21) Appl. No.: 10/498,164

(22) PCT Filed: Dec. 10, 2002

(86) PCT No.: PCT/CA02/01912

§ 371 (c)(1),
(2), (4) Date: Jun. 9, 2004

(87) PCT Pub. No.: WO03/054332

PCT Pub. Date: Jul. 3, 2003

(65) Prior Publication Data

US 2005/0040658 A1 Feb. 24, 2005

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23, 229
See application file for complete search history.

(56) References Cited

U.S. PATENT DOCUMENTS 4,783,102 A * 11/1988 Bernard ..... 292/216
4,978,153 A * 12/1990 Hirsch et al. ..... 292/201
5,020,838 A * 6/1991 Fukumoto ..... 292/201
5,118,146 A 6/1992 Watanuki
5,137,311 A * 8/1992 Brackmann ..... 292/216
5,309,745 A * 5/1994 Ursel et al. ..... 70/264
5,802,894 A * 9/1998 Jahrsetz et al. ..... 70/264
5,868,444 A 2/1999 Brackmann et al.
5,934,717 A 8/1999 Wirths et al.
5,938,253 A * 8/1999 Szablewski et al. ..... 292/216
5,979,951 A * 11/1999 Shimura ..... 292/216
6,059,327 A 5/2000 Yoshikuwa
6,076,868 A * 6/2000 Roger et al. ..... 292/201
6,155,124 A * 12/2000 Wirths ..... 74/89.13
6,247,732 B1 6/2001 Alton
6,364,379 B1 4/2002 Roberts et al.
6,378,920 B1 * 4/2002 Ostrowski et al. ..... 292/216

(Continued)

FOREIGN PATENT DOCUMENTS

DE 3406116 8/1985

(Continued)

*Primary Examiner*—Carlos Lugo
(74) *Attorney, Agent, or Firm*—Clark Hill PLC

(57) ABSTRACT

A latch (1) for a deck lid includes a load lever (41) that operates after the latch (1) is released to prevent the pawl (22) from immediately returning to a latched position. The load lever (41) acts on a pawl lever (21) which in turn acts on the pawl (22). The load lever (41) enables the latch (1) to release even under load such as that created by a heavy layer of snow on the deck lid. The load lever (41) only operates during the opening cycle of the latch (1) and automatically resets as the ratchet (29) moves to the fully open condition.

8 Claims, 9 Drawing Sheets

U.S. PATENT DOCUMENTS

| | | | | |
|---|---|---|---|---|
| 6,390,517 | B1 | 5/2002 | Ehret | |
| 6,519,986 | B2 * | 2/2003 | Wicker | 70/237 |
| 6,679,531 | B2 * | 1/2004 | Rogers et al. | 292/216 |
| 6,817,636 | B1 * | 11/2004 | Evans et al. | 292/201 |
| 2003/0038484 | A1 * | 2/2003 | Schwaiger et al. | 292/201 |
| 2003/0038485 | A1 * | 2/2003 | Schwaiger et al. | 292/201 |
| 2004/0094971 | A1 * | 5/2004 | Warmke et al. | 292/201 |
| 2005/0082842 | A1 * | 4/2005 | Warmke et al. | 292/216 |

FOREIGN PATENT DOCUMENTS

| | | | |
|---|---|---|---|
| DE | 199 29 103 | A1 | 6/1999 |
| DE | 199 30 339 | A1 | 7/1999 |
| DE | 200 16 106 | U1 | 9/2000 |
| DE | 19929103 | * | 12/2000 |
| DE | 20016106 | * | 12/2000 |
| DE | 19930339 | * | 1/2006 |
| FR | 2 804 713 | A1 | 2/2000 |
| FR | 2804713 | * | 2/2000 |
| GB | 2155535 | A | 9/1985 |
| WO | WO 01/02677 | | 6/2000 |
| WO | WO 01/02677 | A2 | 1/2001 |

* cited by examiner

SNOW LOAD LEVER WITH TWO PART PAWL LEVER CONSTRUCTION

FIELD OF THE INVENTION

The present invention relates to a deck lid or liftgate latch with a mechanism to maintain the latch, once released, in the released position even when the deck lid itself is subject to a load, such as snow.

BACKGROUND OF THE INVENTION

It is a relatively common occurrence that the pawl of a deck lid latch or of a liftgate latch of a vehicle once released from the engaged or latched position will immediately return to that position preventing the deck lid or liftgate from opening. This happens when there is weight e.g., the weight of snow, the weight of a person etc. on the deck lid or liftgate causing the latch once released to immediately re-engage. The same is true if the seals or pop-up of the lid or liftgate do not "pop-up".

The releasing of the deck lid/liftgate can be accomplished by a person inside the automobile. Annoyingly that person does not know that the latch has not unlatched until he or she is outside of the vehicle trying to lift the lid or liftgate.

In the past, there have been latches with ratchet blocks to prevent the situation described above. However, these prior art blocks interact directly with the pawl resulting in pawl lock up problems. When these problems occur the ratchet cannot be held by the pawl in a position to positively engage the striker in which case the latch cannot properly latch and close the deck lid or liftgate.

SUMMARY OF THE PRESENT INVENTION

The present invention relates to a latch for a deck lid or liftgate with a snow load or other load type block to prevent immediate re-engagement of the latch once the latch has been deliberately released. This block acts on a pawl lever rather than directly on the pawl to essentially eliminate lock up of the pawl.

The latch itself comprises a ratchet moveable between a latched position and an unlatched position. The ratchet is urged under spring pressure to move to the unlatched position. A pawl is moveable between an engaged position and a released position. The pawl is urged under spring pressure to move to the engaged position holding the ratchet in the latched position. An actuator moves the pawl through a separate pawl lever away from the engaged position. A load lever is moveable to and from a blocking position. The load lever is biased to move to the blocking position to hold the pawl lever where it prevents the pawl from immediately returning to the engaged position after the pawl has been moved to the released position. This allows the ratchet, even when the deck lid is under load, to spring to the unlatched position, allowing the deck lid or liftgate to be opened.

The ratchet when moved from the unlatched position back to the latched position through impact of a striker closing the latch causes the load lever to be pushed away from the blocking position allowing the pawl to spring back to the ratchet engaged position.

According to one aspect of the invention, there is provided a vehicle latch having a ratchet moveable between a latched position and a unlatched position. The ratchet is urged under spring pressure to move to the unlatched position. A pawl is moveable between a ratchet engaged position and a ratchet released position. The pawl is urged under spring pressure to move to the ratchet engaged position holding the ratchet in the latched position. A pawl lever engages the pawl. An actuator moves the pawl lever which in turn moves the pawl away from the ratchet engaged position. A load lever is moveable to and away from a blocking position. The load lever is biased to the blocking position. The load lever moves to the blocking position after pawl lever moves the pawl to the released position and holds the pawl and prevents the pawl from returning to the ratchet engaged position thereby allowing the ratchet to move to the unlatched position. A slapping lever is moved by the ratchet when the ratchet is moved from the latched position to the unlatched position, responsively moving the load lever from the pawl blocking position allowing the pawl to return to the ratchet engaged position.

BRIEF DESCRIPTION OF THE DRAWINGS

The above as well as other advantages and features of the present invention will be described in greater detail according to the preferred embodiments of the present invention in which.

DETAILED DESCRIPTION OF THE PRESENT INVENTION

Figure 1:
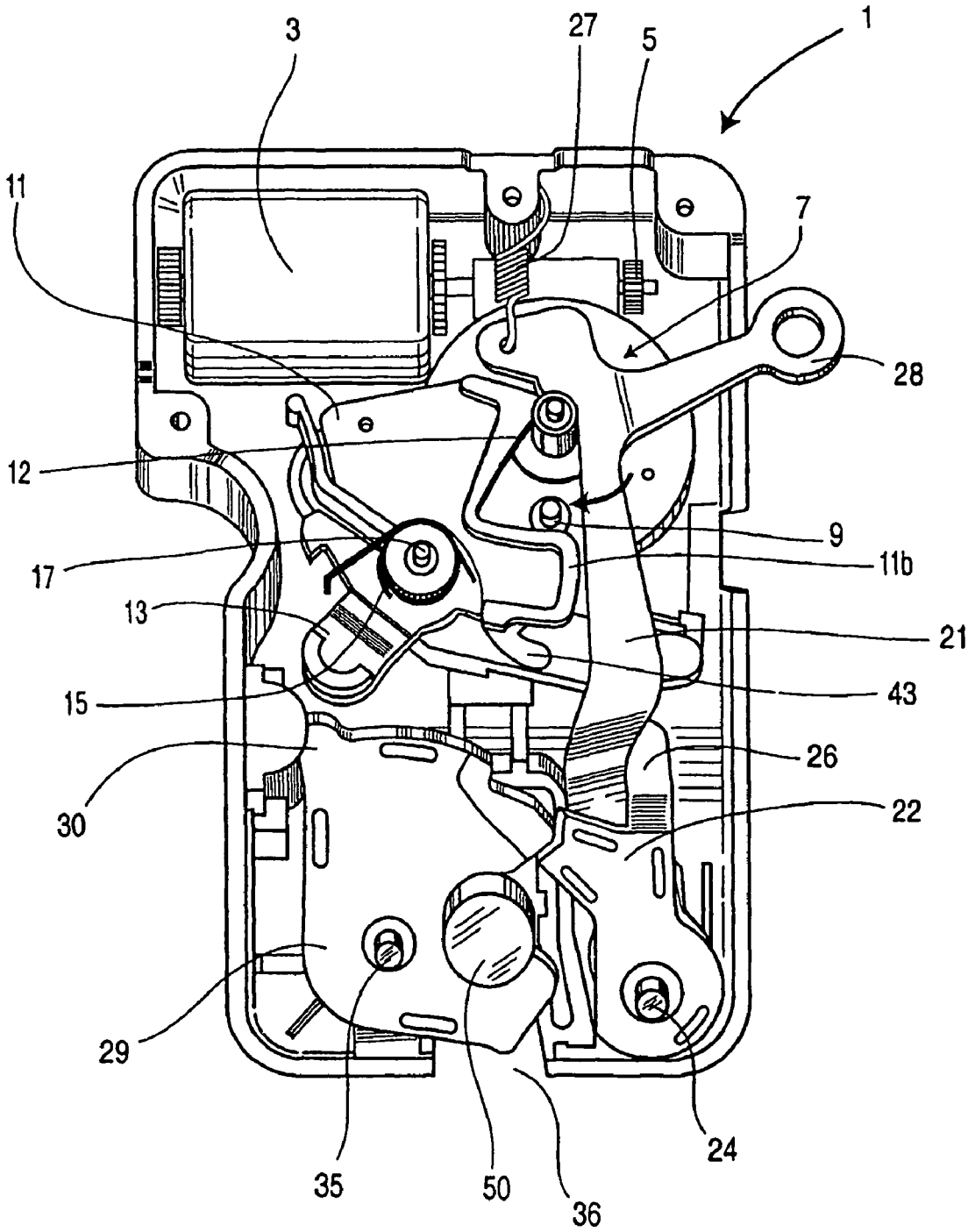
FIGS. 1 through 8 are top views of the latch with the top cover removed showing the different operating phases of the latch with the snow load lever and two part pawl lever construction according to a preferred embodiment of the present invention.

Referring to FIG. 1, the latch of the present invention is generally indicated at 1 and includes a power release actuator mechanism formed by a motor 3, a main gear 7, a toggle 11, a pawl lever 21, a pawl 22 and a ratchet 29. Also provided in accordance with the present invention is a snow load lever 41.

The output shaft of motor 3 drives a pivot gear 5 which rotates the main gear 7, which is journal mounted to the housing, comprising a base plate 37 and a cover plate 39. Gear 7 is provided with a boss or pin 9 that orbits through a circular path with driven rotation of gear 7.

Toggle 11, which is pivotally mounted on a toggle shaft 17 includes a slapping lever 13 which is mounted to swing relative to the main body of the toggle 11. A slapper spring 15 provides a firm, yet movable connection between the slapping lever and the main body of the toggle 11. The toggle 11 is also held in a movable yet firm position within the latch by toggle spring 19. Spring 19 center biases toggle 11 into a ready position or a blocking position. Toggle II has a V-shaped cam surface 12.

Load lever 41 is commonly mounted on toggle shaft 17. Load lever 41 is generally elongate having an embossed cam surface 43. Preferably, cam surface 43 is arcuate. Cam surface 43 cooperates with the underside of the slapping lever 13. Load lever 41 pivots between a blocking position and a ready position. In the ready position, the load lever 41 is out of the travel of pawl lever 21. In the blocking position, the load lever 41 engages the pawl lever 21 to retain the pawl lever 21 in the pulled position.

Pawl lever 21 and the pawl 22 are both mounted on a common pawl pivot 24 and movable independently of one another. Pawl 22 is encased by a plastic cover or encapsulation 23. Pawl 22 is moveable between an engaged position and a released position. The pawl 22 is biased to move to the engaged position holding the ratchet 29 in the latched position. In the released position, the pawl 22 is pivoted away allowing the ratchet 29 to rotate.

Pawl 22 has a tab 26 extending out of the general plane of the pawl and engages with pawl lever 21. Pawl lever 21 is generally elongate having an arm 28 extending out of the housing. The distal end of pawl lever has a spring 27 that biases the pawl lever 21 to a ready position.

The ratchet 29 is mounted to the housing by a pivot pin 35. The ratchet 29 is covered by encapsulation 31. The ratchet 29 is moveable between a latched position and an unlatched position. The ratchet 29 is urged under spring pressure to move to the unlatched position. The ratchet has two detents 51, 53 that cooperate with the pawl 22 to close the latch in a secondary and primary closed positions. The ratchet 29 cooperates with a mouth 36 of the base plate 37 to engage a striker 50 and latch thereto and unlatch therefrom.

The entire mechanism is contained within a base plate 37 and a cover 39, which are preferably made of plastic. A steel reinforcement plate 141 then fits over the plastic cover.

As earlier mentioned in the description FIGS. 1 through 5 show the various different phases of the cycle of operation of the release actuator mechanism.

FIG. 1 shows the start of the release cycle. The boss 9 of gear 7 is in its "home" position. The motor 3 operates to turn gear 7 orbiting boss 9 in the clockwise direction. Toggle 11 is in a first position. Gear 7 is able to rotate as boss 9 travels or follows along cam surface 12.

Figure 2:
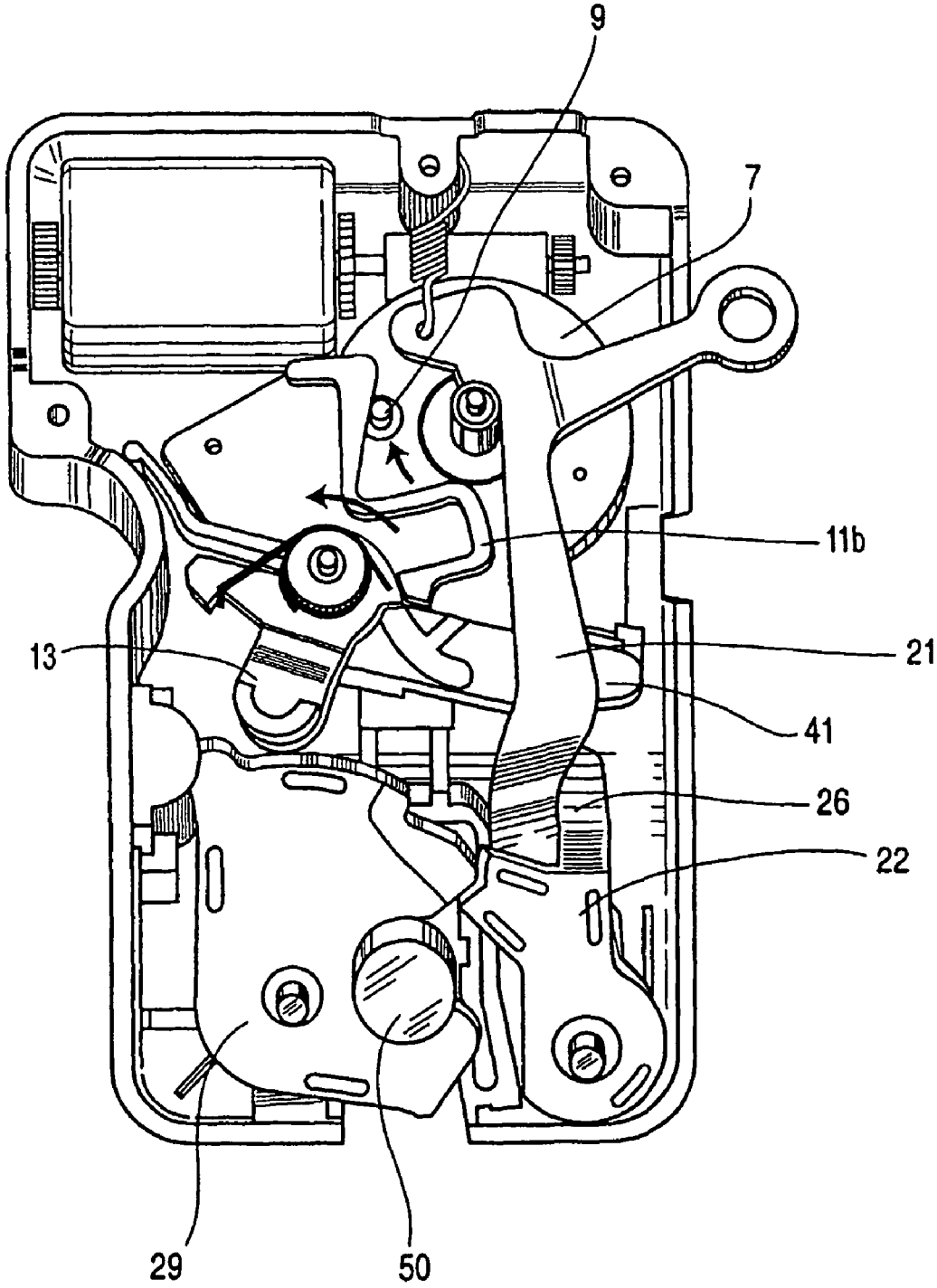

FIG. 2 shows the priming phase of the mechanism. Boss 9 has orbited along the cam surface 12, rotating the toggle 11 to a second position.

Figure 3:
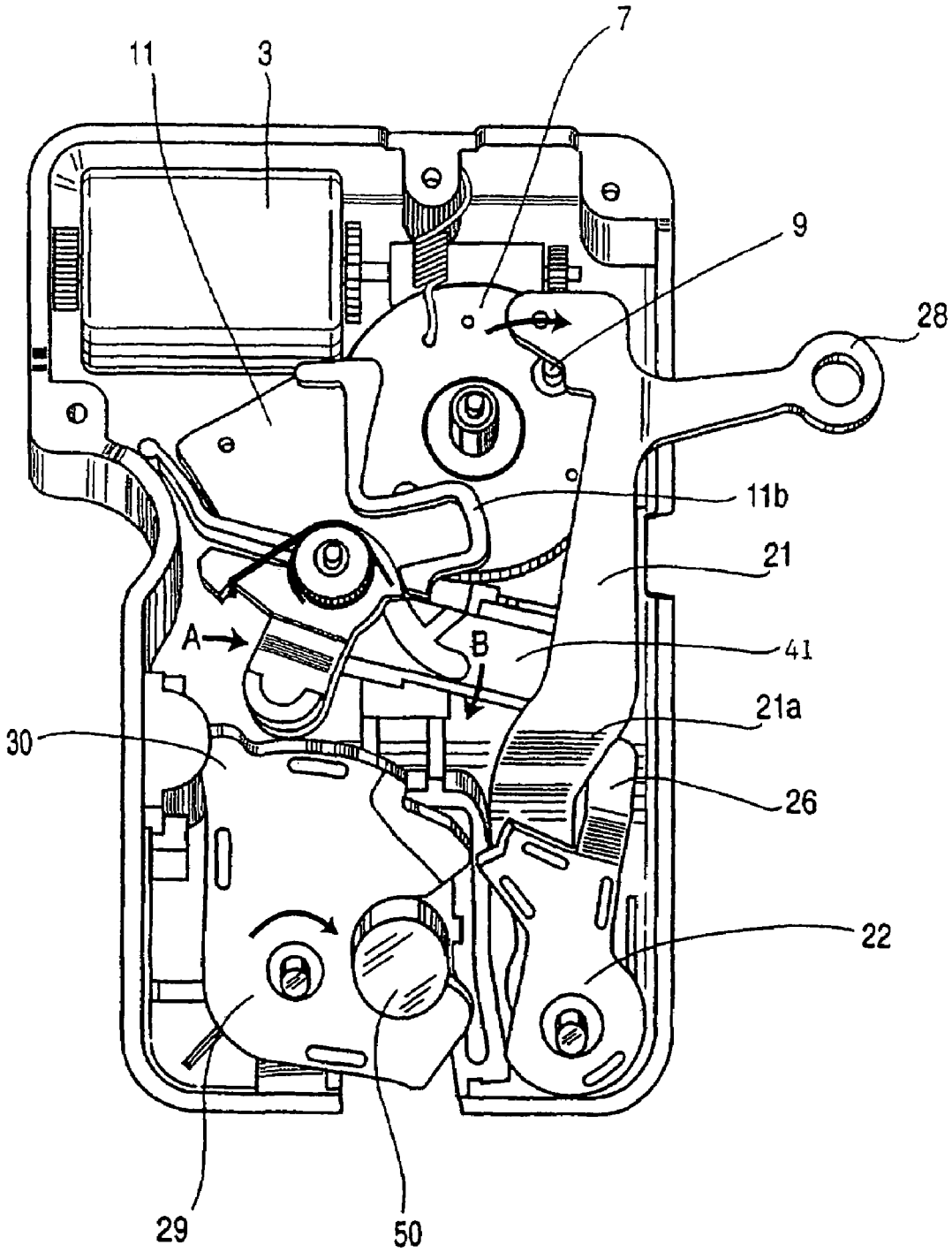

FIG. 3 shows the release phase of the cycle. In this phase, the gear 7 has continued to rotate through the operation of the motor such that boss 9 engages and pushes on the pawl lever 21. The pawl lever 21 in turn engages the pawl 22 to also push the pawl away to the released position. The ratchet is able to rotate to the open or unlatched position i.e., a position in which it would release the striker.

During this phase, the boss 9 has been continuing to orbit past the pawl lever 21 until the boss 9 encounters toggle portion 11*b*. At this point, the toggle 11 blocks any further rotation of the gear 9 and stalls the operation of the motor 3. This causes the motor 9 to shut down until another operating cycle of the mechanism.

A number of additional steps occur during the end of opening phase of the cycle. First of all, ratchet 29 has a protrusion 30. As the ratchet rotates from the latched position to the unlatched position, the protrusion engages the toggle slapping lever 13. Slapping lever 13 must be pushed out of the way by the ratchet to clear the slapping lever past the ratchet, i.e., the slapping lever is pivoted in the direction of arrow A shown in FIG. 3 of the drawings as the ratchet opens to allow the ratchet protrusion 30 to pass the slapping lever 13.

Figure 4:
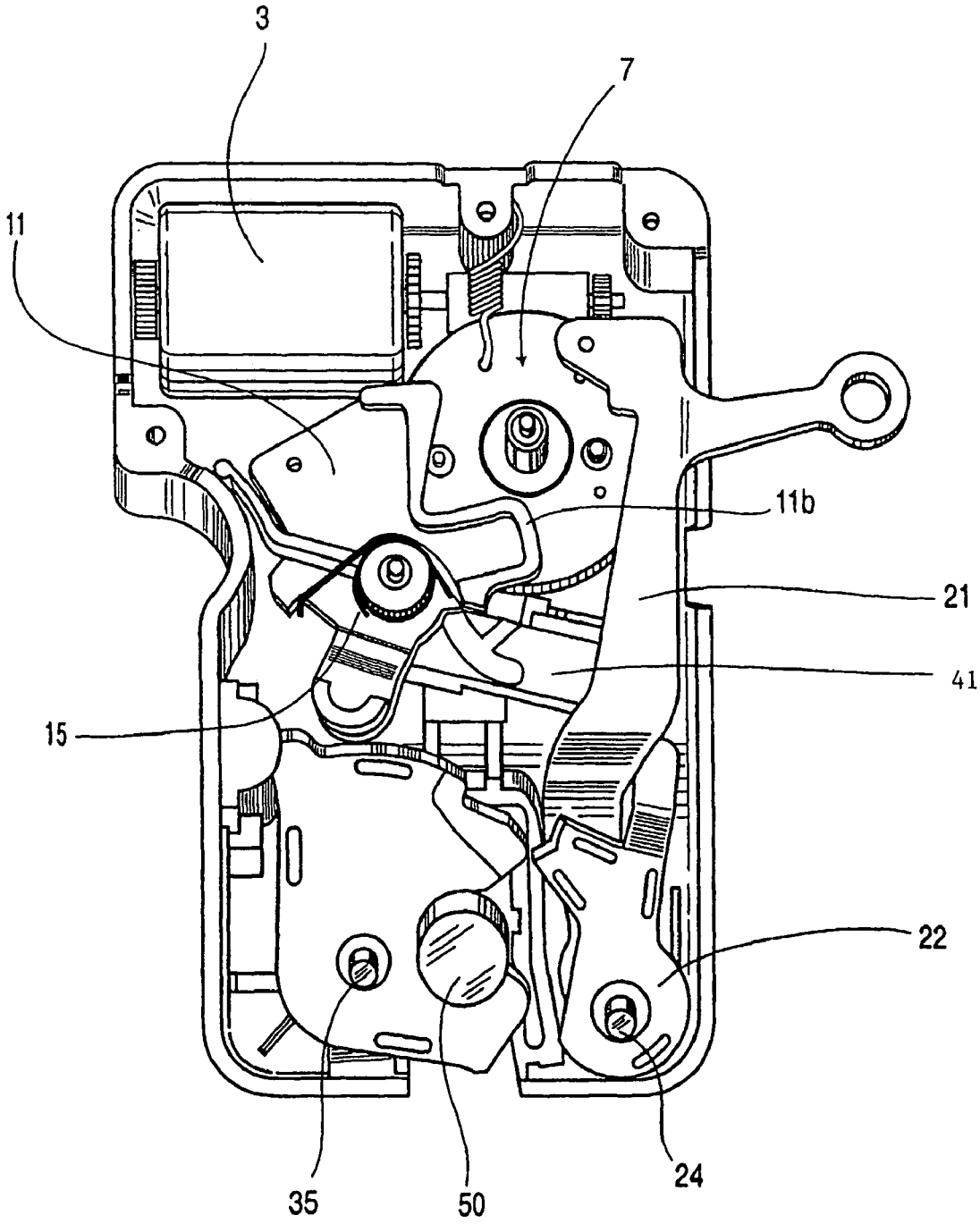
Figure 5:
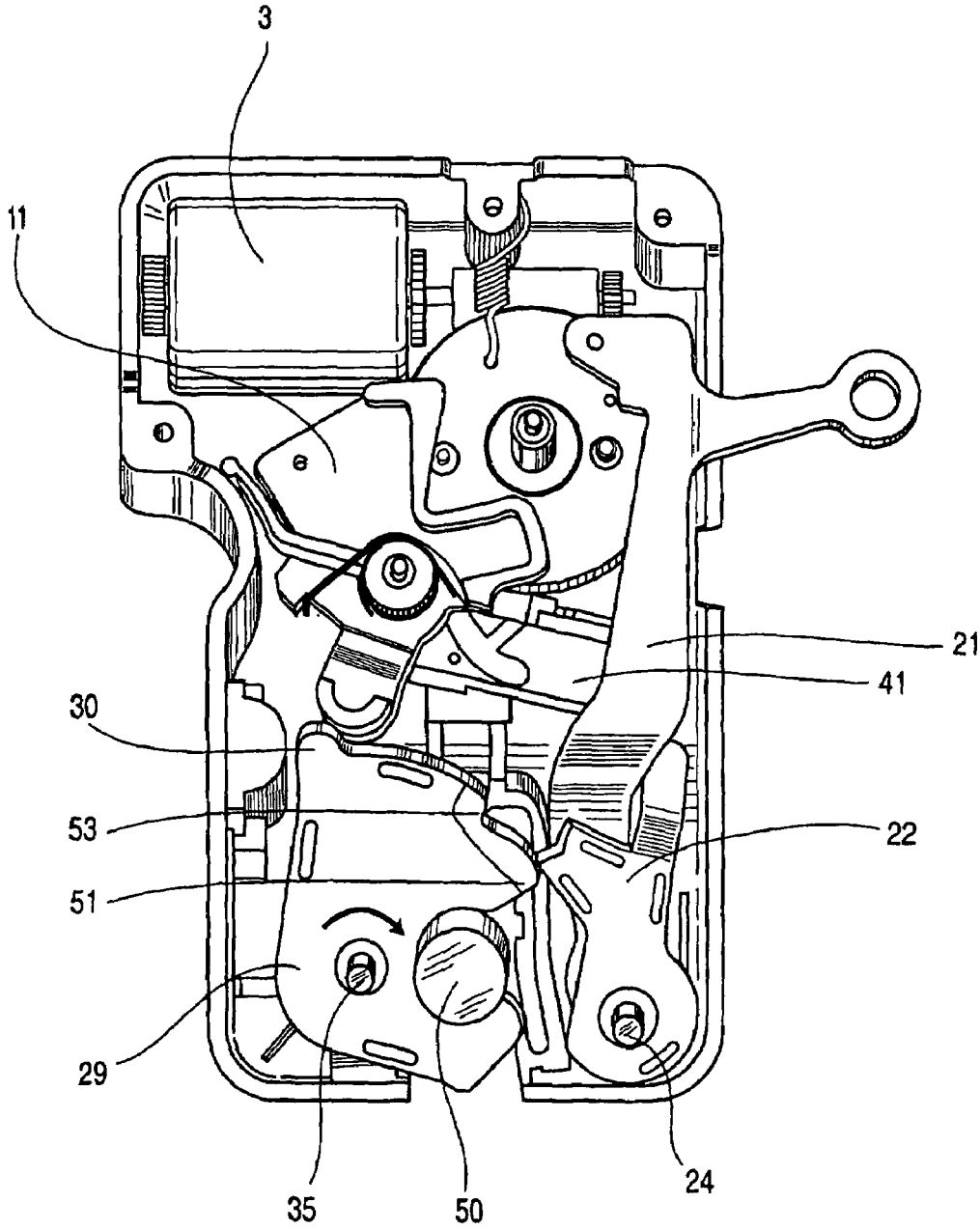
Figure 6:
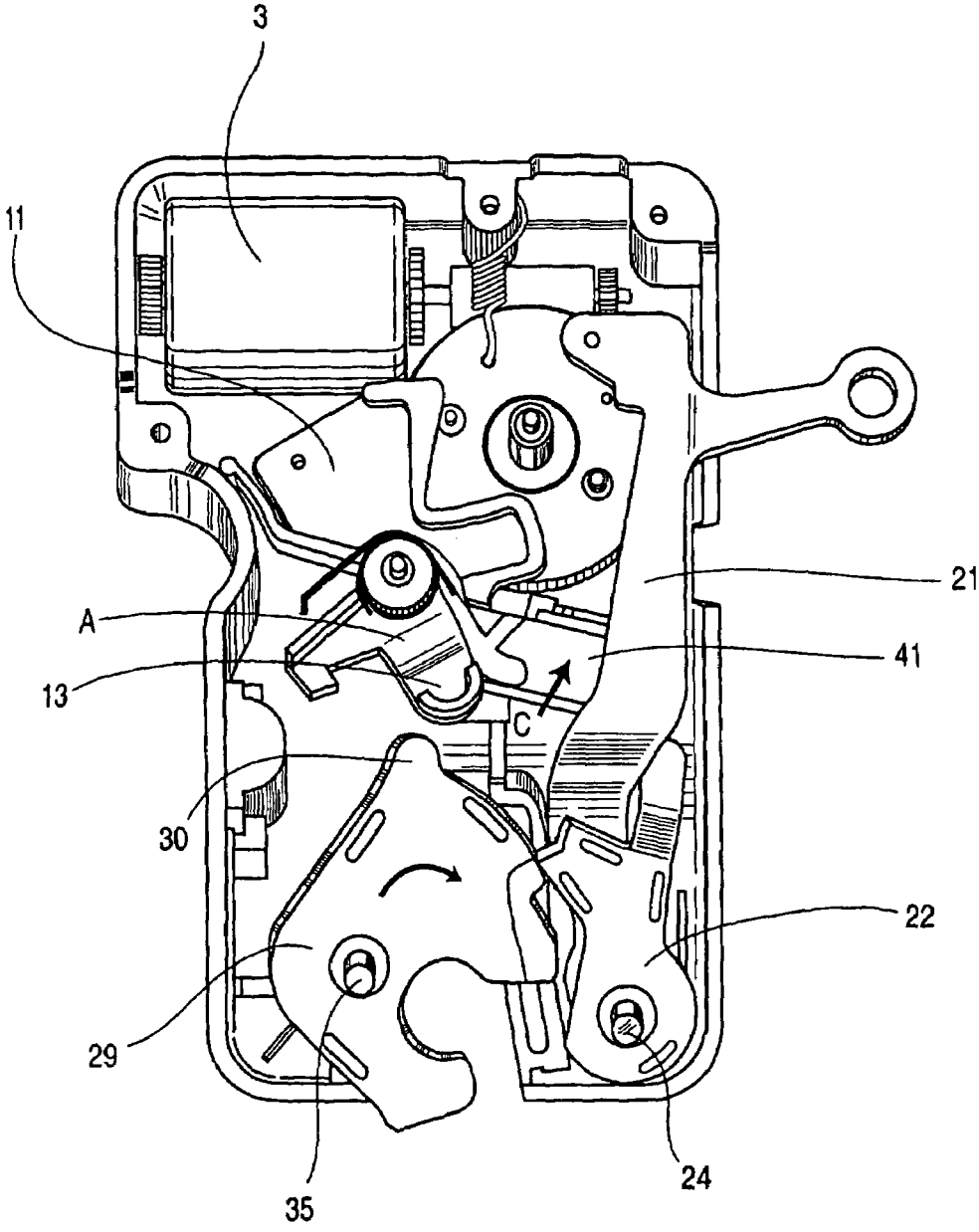
Figure 7:
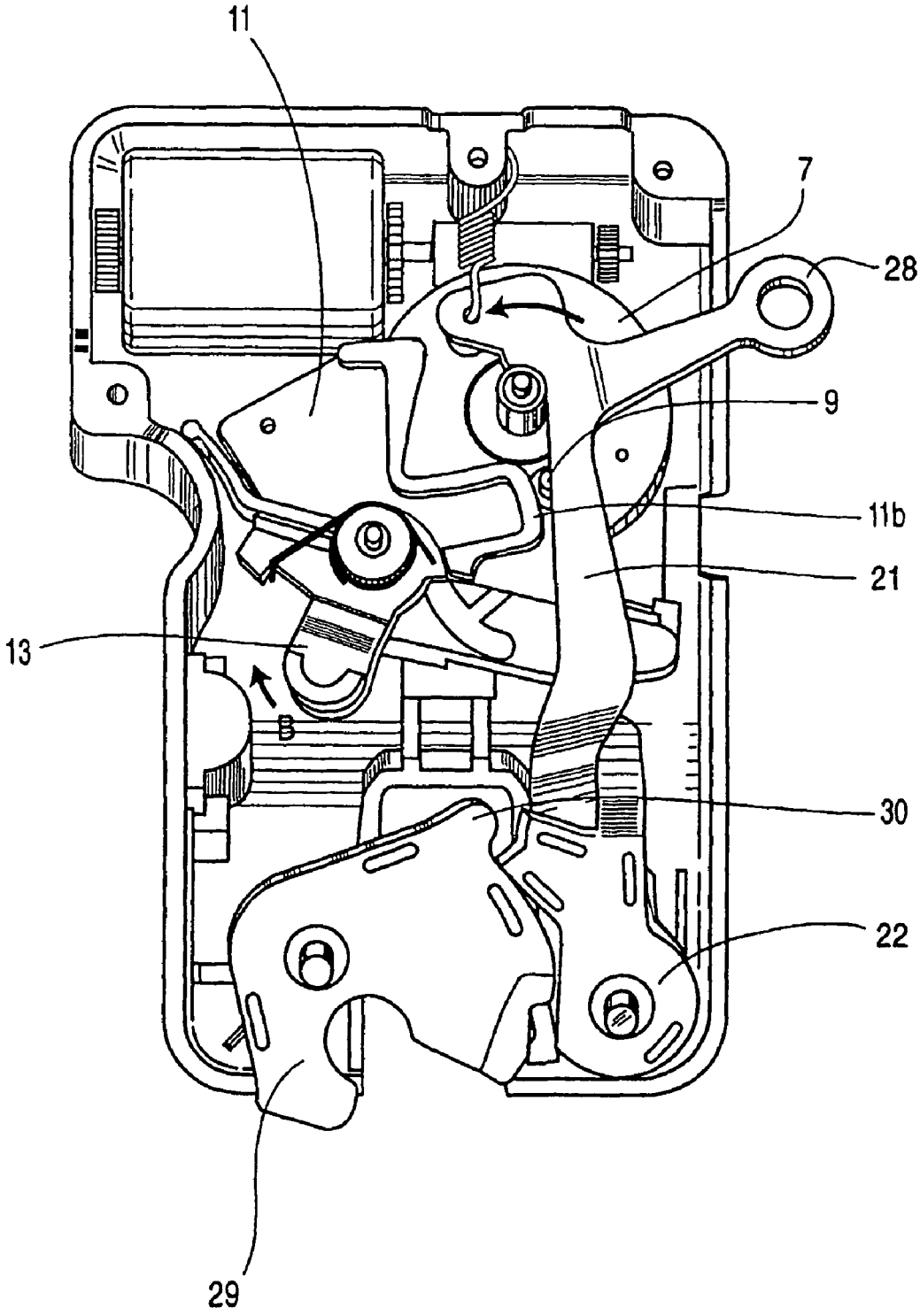

Through the provision of the slapper spring, the slapping lever 13 returns to the neutral position, as shown in FIG. 4, once the ratchet 29 has moved to its unlatched position. The pawl lever 21 has moved back to its FIG. 1 position while the pawl 22 itself remains in the FIG. 3 position locked by the ratchet in its open position.

Figure 8:
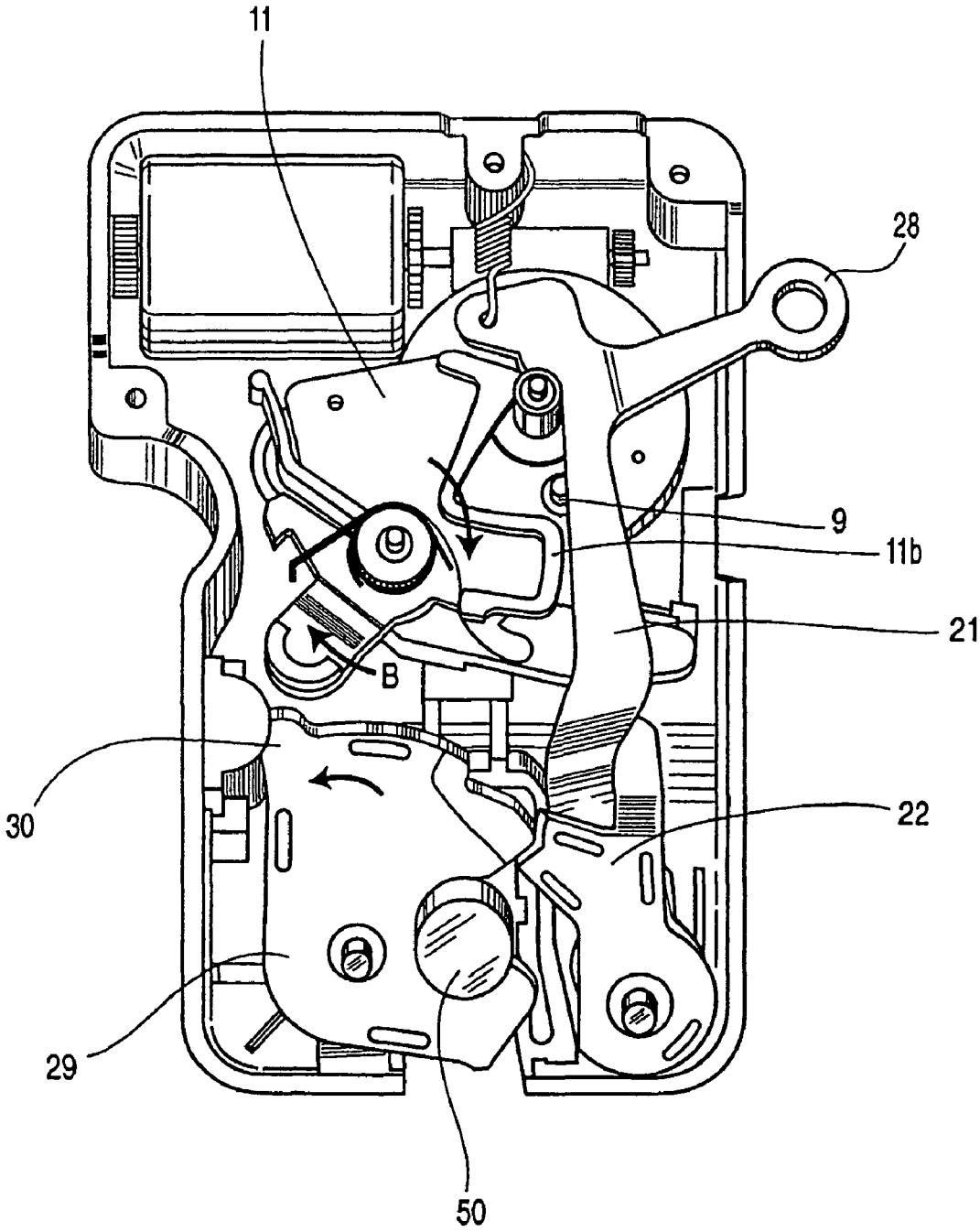
Figure 9:
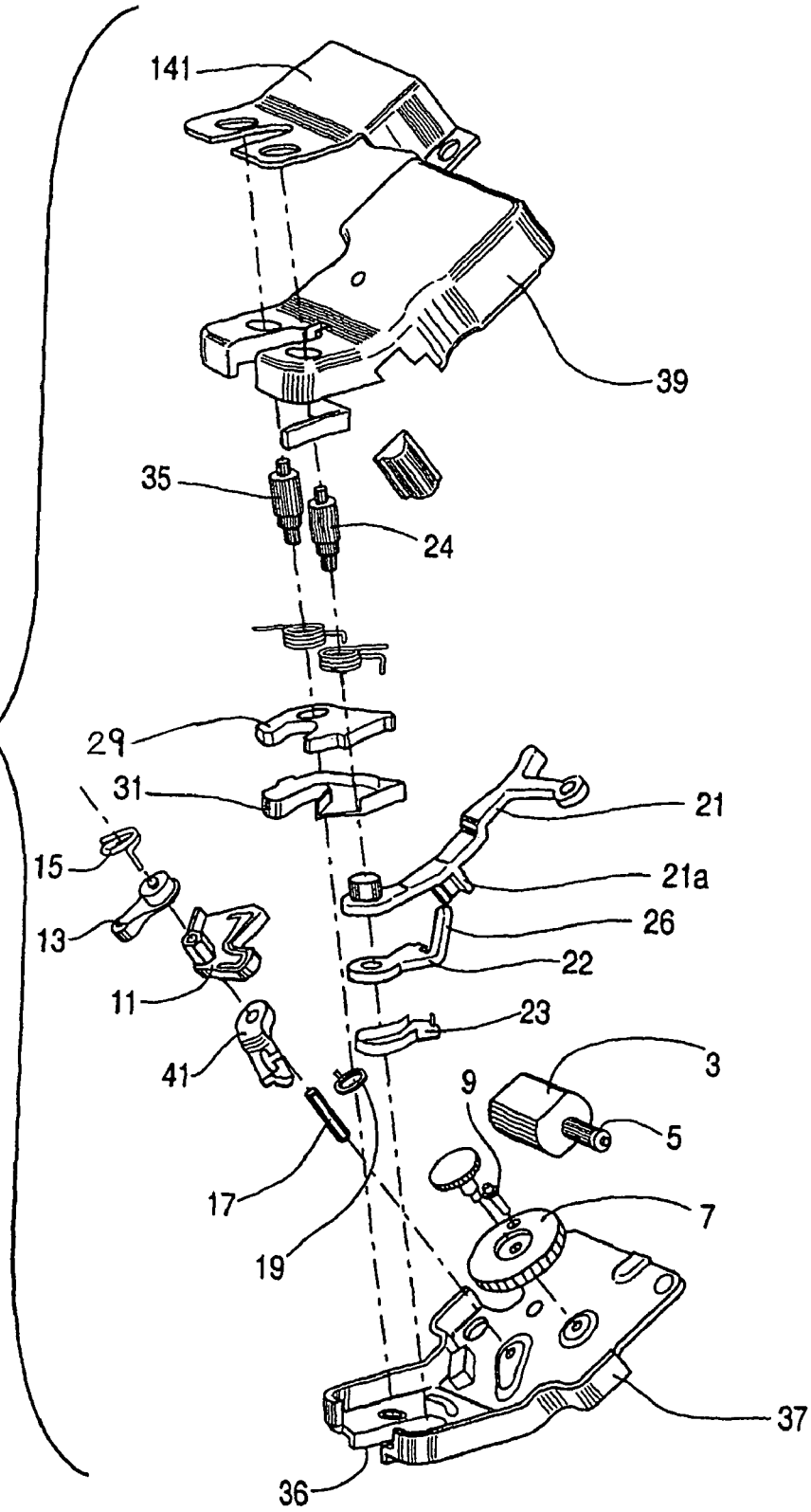
FIG. 9 is an exploded perspective view of the latch.

FIG. 8 of the drawings shows the closing phase which is the final phase of the operating cycle of the mechanism. This closing phase is initiated by impacting the ratchet 29 with the striker which causes the ratchet 29 to move back to its latched or closed position. As shown in FIG. 8, this frees the pawl 22 to spring back to its engaged position and prevent the ratchet 29 from opening until the next operating cycle of the mechanism.

As the ratchet 29 is closed by the impact with the striker, the protrusion 30 engages the other side of the slapping lever 13 to push the slapping lever in the direction of arrow B as shown in FIG. 8 of the drawings. This in turn causes the toggle 11 to move back to the FIG. 1 position moving toggle portion 11*b* out the orbital path of the boss 9. The slapping lever 13 then returns under spring pressure to its neutral position and the mechanism is now ready for its next operating cycle.

A number of unique features result from the above operation of the mechanism. For example, the ratchet itself provides a resetting of the snow load mechanism of the present invention.

The feature of the invention which prevents loads such as snow loads from preventing proper operation of the latch will now be described.

Load lever 41 is pivotally mounted on toggle shaft 17. Load lever 41 engages pawl lever 21 preferably at tab 21A. When the load lever 41 is in the position as shown in FIGS. 1 and 2, the load lever 41 has no impact on the operation of the latch. However, as the pawl lever 21 is moved by the boss 9 into the release phase the pawl lever 21 is pushed past the end of the load lever 41. The load lever under the pressure of spring 15 moves in the direction of arrow B as shown in FIG. 3 to a second position shown in FIGS. 4 and 5 of the drawings. In this second position, the end of the load lever 41 engages the pawl lever 21 at tab 21A. The load lever 41 holds the pawl lever 21 in the pulled position to maintain the pawl 22 in the released position. The ratchet 29 is now free to move from the latched position to the unlatched position. If the deck lid or liftgate is loaded, the pawl 22 remains in the released position even after the release cycle of the latch 1 has completed.

The load lever 41 operates in the same manner even if the pawl lever 21 is actuated manually through manipulation of arm 28.

The resetting of the snow load lever 41 back to its ready or non-blocking position occurs with the end of opening phase of the latch cycle. In this phase, as earlier described, the protrusion 30 pushes the slapping lever 13 as shown in FIG. 4 as the ratchet 29 is rotating from the latched position to the unlatched position. The slapping lever 13 cooperates with the cam surface 43 to push the snow lever 41 in the direction of arrow C in FIG. 4 away from the blocking position. However, this does not occur until the ratchet 29 is fully unlatched ensuring the release of the latch.

The load lever 41 and the pawl lever 21 do not move on the closing of the latch 1, when the ratchet 29 moves from the unlatched to the latched position. This feature ensures that the load lever 41 does not inadvertently engage, preventing the latch 11 from latching. The snow load function only operates during the opening cycle ensuring full release of the latch from the primary latch and secondary latch positions to the full open position.

Although the drawings show, and the description immediately above relates to the protrusion 30 acting on the snow load lever 41 through the slapper lever 13, it is equally possible to have the ratchet 29 act directly on the snow load lever 41 to reset it to the FIGS. 1 and 2 position.

Further, it also apparent that the load lever 41 may be incorporated into a latch that does not incorporate the power release function as described above. The load lever 41 may be pivotally mounted on the housing base 37 and biased to be in either the blocking position or the ready position.

Here it should be noted that the snow load lever 41 does not directly engage the pawl 22 which eliminates pawl lock up that would adversely affect operation of the latch.

Although various preferred embodiments of the present invention have been described in detail, it will be appreciated by those skilled in the art that variations may be made without departing from the scope of the appended claims.

What is claimed is:

1. A vehicle latch comprising:

a ratchet moveable between a latched position and an unlatched position, said ratchet being urged under a first spring pressure of a first spring to move to said unlatched position;

a pawl moveable between an engaged position and a released position, said pawl being urged under a second spring pressure of a second spring to move to said engaged position holding said ratchet in said latched position;

a pawl lever engaging said pawl, said pawl lever moveable between a ready position and a pulled position for moving said pawl from said engaged position to said released position, said pawl lever being urged under a third spring pressure of a third spring to said ready position, wherein said pawl lever and said pawl are mounted on a common pivot; and a load lever moveable to and away from a blocking position, in said blocking position said load lever engaging said pawl lever thereby maintaining said pawl lever in said pulled position and at the same time said pawl lever engaging and maintaining said pawl in said released position, said load lever moving to said blocking position in response to a fourth spring pressure of a fourth spring as said pawl lever is urged to said pulled position, said load lever cooperating with said ratchet and moving from said blocking position in response to said ratchet reaching said unlatched position thereby allowing said pawl lever to move from said pulled position to said ready position and said pawl to move from said released position to said engaged position.

2. A vehicle latch according to claim 1, wherein said latch further comprises a housing, including a base and a cover, said ratchet, pawl, pawl lever and load lever being pivotally mounted on said base.

3. A vehicle latch according to claim 2, wherein said latch further comprises a power release mechanism operative to remotely release said latch.

4. A vehicle latch according to claim 3, wherein said power release mechanism comprises an actuator cooperating with said pawl lever to move said pawl lever from said ready position to said pulled position.

5. A vehicle latch according to claim 4, wherein said power release mechanism comprises:

a rotatable gear with a gear boss thereon;

an actuator drivingly engaging said gear to orbit said gear boss through an operating cycle of said power release mechanism;

a toggle pivotally movable between a first toggle position and a second toggle position, said toggle being biased to either said first toggle position or said second toggle position, said gear boss encountering said toggle and pivoting said toggle from said first toggle position to said second toggle position, said toggle presenting a stop to said gear boss terminating said operating cycle when said toggle is in said second toggle position; and a slapper lever movable to pivot said toggle from said second toggle position to said first toggle position in response to said ratchet moving from said unlatched position to said latched position.

6. A vehicle latch according to claim 5, wherein said bias of said toggle allows over-rotation of said toggle beyond said second toggle position.

7. A vehicle latch according to claim 6, wherein said operating cycle of said power release mechanism comprises a start of release phase, a priming phase, a release phase, an end of release phase and a closing phase; in said start of release phase said toggle being in said first toggle position where said gear boss is free to orbit and said actuator starts to rotate said gear to said priming phase in which said gear boss pushes said toggle to said second toggle position, said actuator continuing to rotate said gear to said release phase in which said gear boss pushes on said pawl lever which in turn pushes said pawl away from said engaged position whereby said ratchet moves away from said latched position to said unlatched position, said actuator continuing to rotate said gear to orbit said gear boss to said end of release phase where said gear boss is blocked by said toggle in said second toggle position to stop rotation of said gear and to stall said actuator which is then ready for said closing phase in which said ratchet is moved, upon impact with a striker back to said latched position, pushing said toggle back to said first toggle position to enable a further operating cycle of said power release mechanism.

8. A vehicle latch according to claim 7, wherein said toggle has a one way lost motion connection to said slapper lever, said lost motion connection allowing said ratchet to rotate from said latched position to said unlatched position.

* * * * *